United States Patent [19]

Langenegger et al.

[11] Patent Number: 4,516,509

[45] Date of Patent: May 14, 1985

[54] OFFICE FURNITURE WITH AN ADJUSTABLE TABLETOP IN MODULAR DESIGN FOR SETUP AT THE WORK PLACE

[75] Inventors: Urs Langenegger, Uznach; Werner Roffler, Hinwil; Wendolin Rütsche, Ruti, all of Switzerland

[73] Assignee: Embru-Werke, Mantel & Cie., Ruti, Switzerland

[21] Appl. No.: 391,148

[22] Filed: Jun. 23, 1982

[30] Foreign Application Priority Data

Jun. 24, 1981 [DE] Fed. Rep. of Germany ..... 3124658
Jun. 24, 1981 [DE] Fed. Rep. of Germany ..... 3124660

[51] Int. Cl.[3] ..... A47B 9/00

[52] U.S. Cl. ..... 108/147; 74/89.15; 108/1; 248/422

[58] Field of Search ..... 108/147, 148, 144, 7, 108/6, 1, 153; 188/67, 41, 42, 43; 248/422, 412, 371, 396, 157; 74/89.15

[56] References Cited

U.S. PATENT DOCUMENTS

| | | | |
|---|---|---|---|
| 457,645 | 8/1891 | Hancock | 108/147 |
| 458,847 | 9/1891 | Hooker et al. | 108/147 |
| 710,561 | 10/1902 | Boyd | 248/422 |
| 1,519,357 | 12/1924 | Campbell | 248/422 |
| 1,758,451 | 5/1930 | Manley | 248/422 |
| 2,368,748 | 2/1945 | Doty | 108/147 |
| 3,118,705 | 1/1964 | Stalnacke | 108/147 |
| 3,385,238 | 5/1968 | Jay | 108/147 |
| 3,938,766 | 2/1976 | Herbolsheimer et al. | 108/147 X |
| 4,397,244 | 8/1983 | Rutsche et al. | 108/1 X |
| 4,422,385 | 12/1983 | Rutsche et al. | 108/153 |

FOREIGN PATENT DOCUMENTS

| | | | |
|---|---|---|---|
| 540605 | 5/1957 | Canada | 108/147 |
| 544892 | 8/1957 | Canada | 248/157 |
| 46140 | 2/1982 | European Pat. Off. | 108/7 |
| 2948618 | 6/1981 | Fed. Rep. of Germany | 108/147 |

*Primary Examiner*—Francis K. Zugel
*Assistant Examiner*—Thomas A. Rendos
*Attorney, Agent, or Firm*—Kinzer, Plyer, Dorn & McEachran

[57] ABSTRACT

This piece of furniture is designed for setup at the work place in a modular design concept and has an adjustable tabletop. At the rear edge of the tabletop (1) there is at least one bolt (27) with a projecting end which passes through a vertical slit (29) in a hollow beam (3). In the hollow space of this beam, there is at least one vertical adjusting spindle (32) which has a follower nut (31). This follower nut is connected to the bolt (27) in such a way that when the spindle is turned, the rear part is raised or lowered. The adjusting mechanism is easy to operate and permits infinite adjustment of the rear side of the tabletop. It takes up very little space, so that electrical lines and other facilities can be housed easily in the hollow space of the beam.

8 Claims, 11 Drawing Figures

IV
IV
36
35
3
32
26
1
27
39
33
31

VI
VI
V
V
29
1
28
30
36
38
35
33
32
31
37
3
34
39

27
26
1
49
36
38
3
37
35
34
31
39
29
30
27
28

OFFICE FURNITURE WITH AN ADJUSTABLE TABLETOP IN MODULAR DESIGN FOR SETUP AT THE WORK PLACE

The office furniture used today for modern work place setup consists of several component elements which can be combined and taken apart again in a modular design concept. Both the height and slope of the tabletop can be adjusted to meet the requirements of a given function and work place.

With conventional office furniture, it is known that tabletop adjustment is possible by means of gears, lever systems, pneumatic spring systems, hydraulic systems, etc. The mechanisms required to accomplish this purpose are generally quite expensive and complicated, and special tools are needed to make an adjustment.

A less expensive form of adjustment is based on simple pin and grid systems, but these have various drawbacks. The pin and grid systems are tedious to operate, the furniture is unstable and the pins are often unsecured, so the tabletop can shift or even fall down.

Another disadvantage of the known type of furniture is that the adjustment devices often take up a great deal of space, so there are difficulties in housing electrical lines and other organizational facilities in the spaces in the side parts and cross beams. It is also difficult to integrate telephones, lamps, display units, signal keyboards, etc., into such furniture or to mount fixtures on it.

This invention is based on the task of creating modular furniture of the type described initially so that these disadvantages are avoided. The table adjustment design should be simple. The adjustment should be continuous and it should be possible for one person to operate it alone without any special tools. In addition, the furniture must be stable and accidental dropping of the tabletop must be impossible.

The solution to this task according to this invention is given by the features defined in the characterization of patent claim 1.

Practical examples of this invention are illustrated below with reference to the figures.

Figure 1:
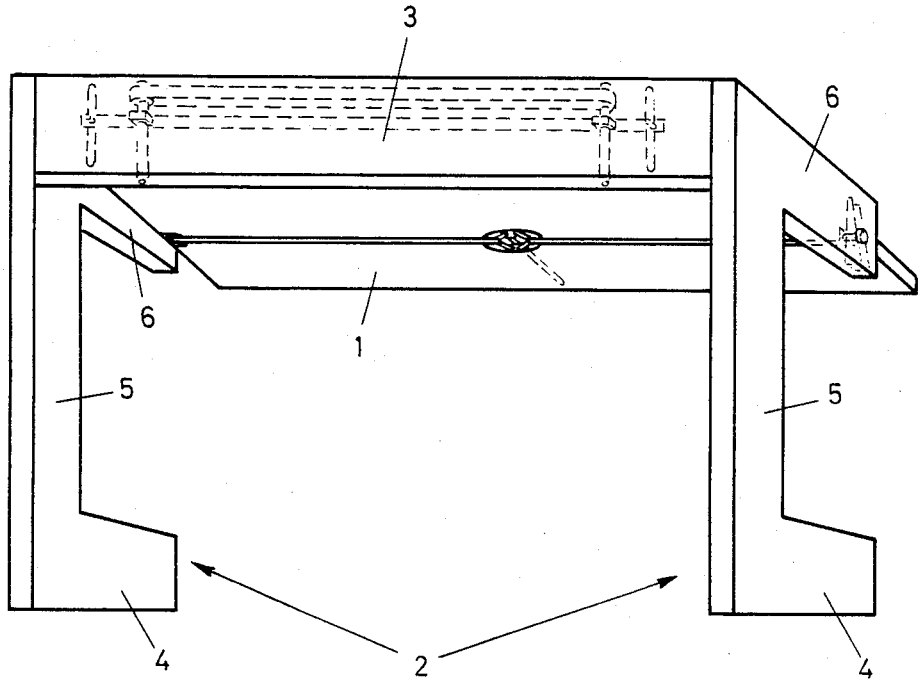
FIG. 1 shows a desk in perspective view, seen from below at the rear.

The desk shown in the figures has a tabletop 1 which can be adjusted in height and slope. The tabletop is mounted in a framework which consists of two hollow side parts 2 and a hollow connecting beam 3. Each of the side parts 2 has a foot 4, a supporting column 5 and a horizontal top side arm 6 which projects away from supporting column 5.

The side arm 6 is designed as a hollow rectangular section which is open at the top and is closed by a cover. Connecting beam 3 which is also designed as a hollow rectangular section that is open at the top and is covered by a section, has a flange on both ends which abutts against the supporting columns 5 and is bolted to them.

The inside spaces of beam 3, side arms 6, supporting column 5 and feet 4 are connected so that electrical lines as well as plug boxes and distributor boxes can be installed easily, as explained below in greater detail.

Tabletop 1 is made of wood and can be covered with a veneer in a known way and surrounded with border strips. It is attached adjustably to side arm 6 as well as connecting beam 3 at the rear.

In the front area of the tabletop 1 there is a round recess 9 between the two side arms 6. In this recess 9 there is an adjusting mechanism which acts on two operating rods 10 which can move lengthwise with regard to the front edge 16 of the desk at the bottom of tabletop 1. These rods 10, which consist of flat steel bars, each have two guide slits 11 near the ends of the rods. Rods 10 are attached loosely to the lower side of the desk by means of screws 12 which fit in the guide slits 11.

The adjusting mechanism has a threaded spindle 13, which has one end rotating freely in block 14 and the other end has a pin 15 into which an adjusting lever can be inserted from the front edge of the desk. The pin may have a hexagonal hole for this purpose.

Threaded spindle 13 has another block 17 which has a threaded hole for the spindle.

Blocks 14 and 17 are connected to the inner ends of operating rods 10 by means of four pairs of levers 18 forming a kind of hinged parallelogram. When threaded spindle 13 is turned, the distance between the two blocks 14 and 17 changes and causes operating rods 10 to move toward the inside or outside of the hinged parallelogram, depending on the direction of rotation of the spindle.

The adjusting mechanism is exposed in the middle and is not attached to the table, i.e., the mechanism is suspended by slits 11 and screws 12. In this way, operating rods 10 may be on the right or the left of the table.

The outer ends 19 of rods 10 are bent at an angle and each have a bolt 20 with head 23. A pair of wedges 21 are positioned vertically in the hollow space of each side arm 6 in such a way that the wedge surface 22 rises toward the lower end. The horizontally measured distance 25' of the wedge surfaces 22 of the two wedge pairs in the two side arms 6 thus increases steadily toward the lower end.

Bolt 20 passes through vertical slit 24 in the wall of side arm 6 and passes vertically between the two wedges 21, so that its head 23 rests on wedge surface 22. The inside surface of the head forms an angle with wedge surface 22.

Figures 2, 3:
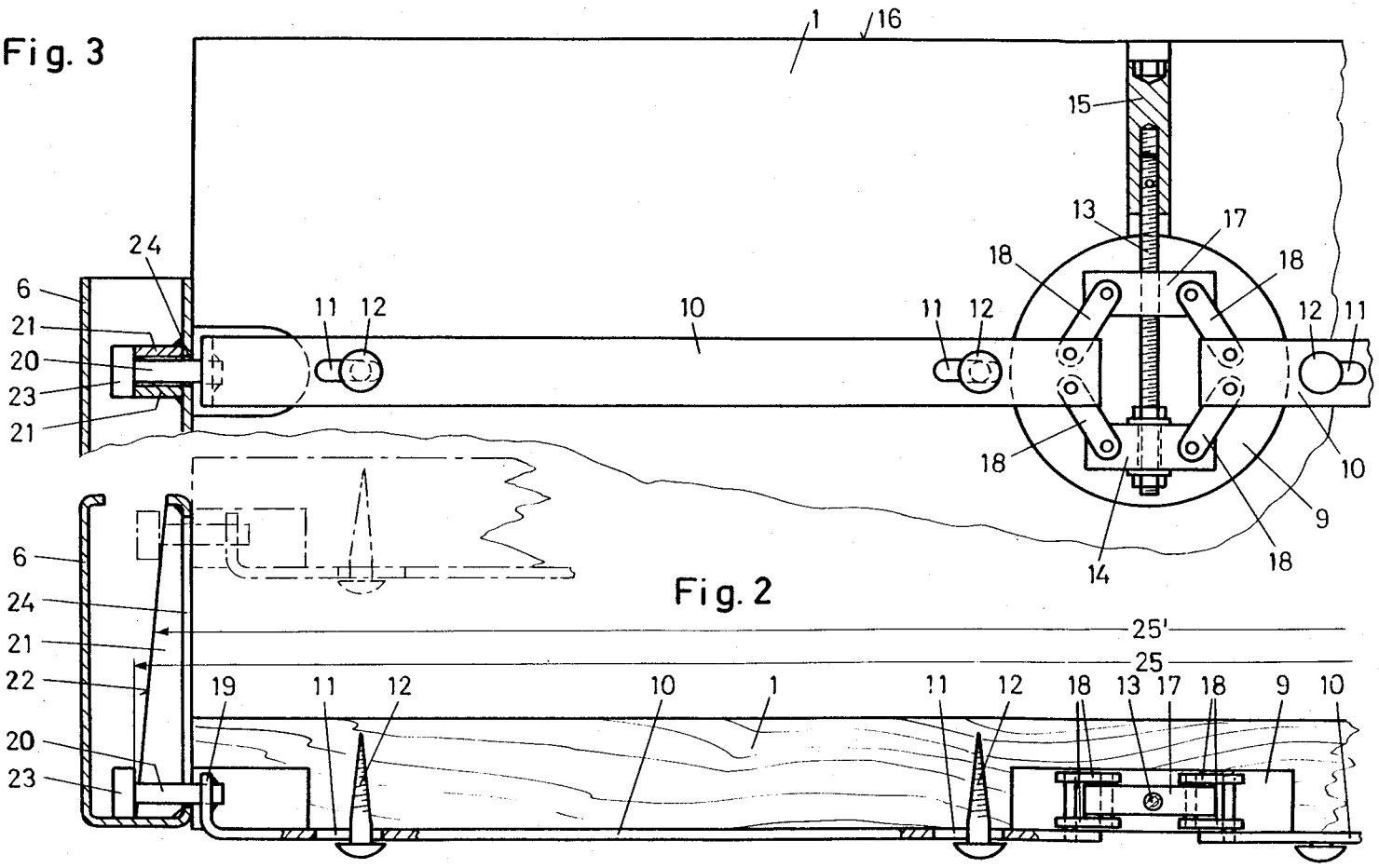
FIG. 2 shows a vertical section through a side arm and a part of the tabletop.
FIG. 3 shows a view below the tabletop as per FIG. 2.
Figures 4, 5, 6:
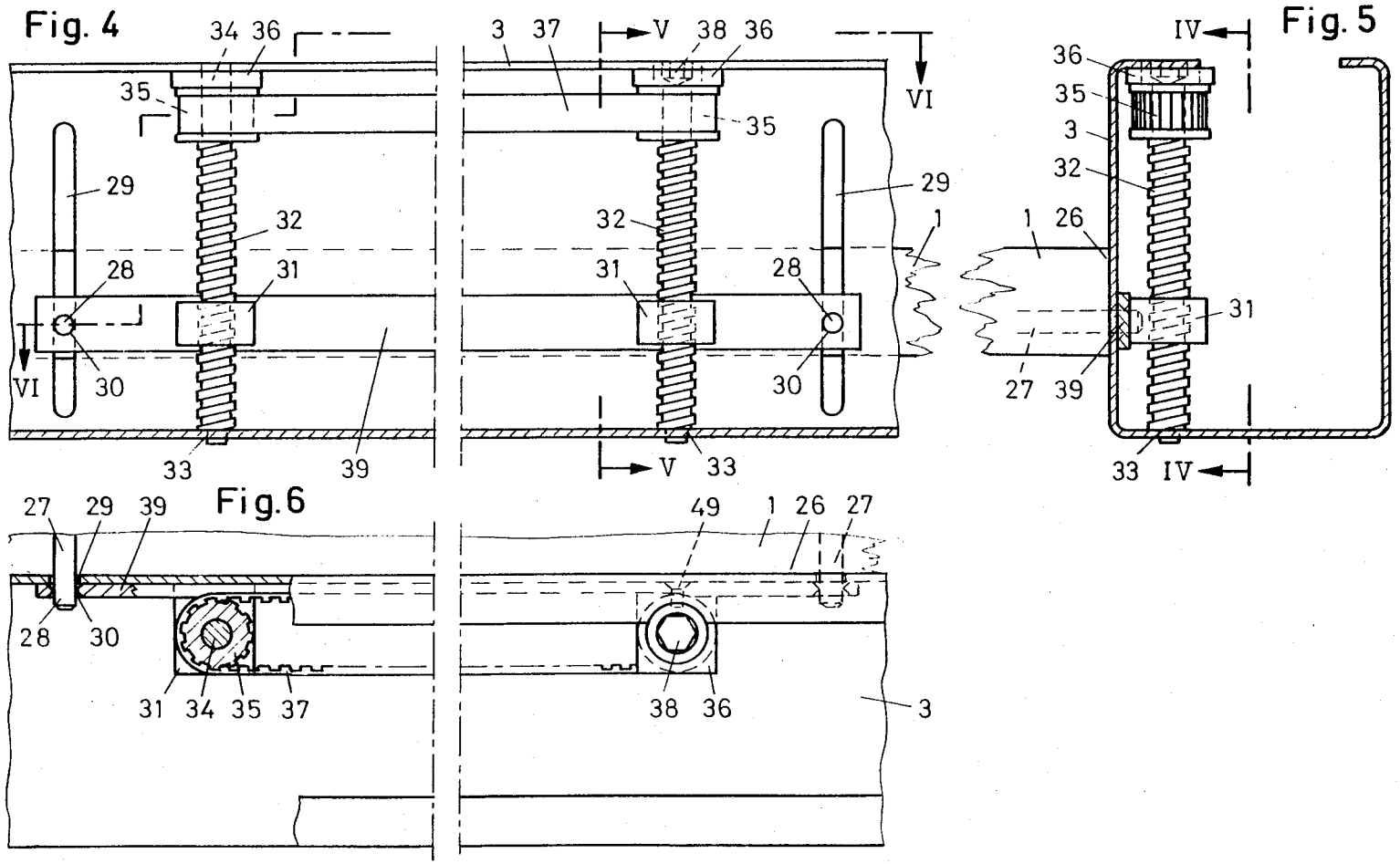
FIG. 4 shows a vertical longitudinal section through the connecting beam according to line IV—IV as per FIG. 5.
FIG. 5 shows a cross section through the connecting beam according to line V—V as per FIG. 4.
FIG. 6 shows a horizontal longitudinal section through the connecting beam according to line VI—VI as per FIG. 4.

In FIG. 2, the front of the tabletop is shown in the upper and lower positions, with the upper position shown in dotted lines.

When the tabletop is in the upper position, operating rods 10 are shifted to the inside. If operating rods 10 are moved outward by means of the adjusting mechanism, bolt heads 23 can slide downward on wedge surfaces 22, and tabletop 1 is inclined downward at the front. Since the head 23 of the bolt touches wedge surface 22 only with one part of the edge, clamping is achieved in this way.

The adjusting mechanism thus serves to vary the distance 25 between the two bolt heads 23 so that each distance 25' corresponds to a similar height position of the front of the tabletop.

The adjustment is continuous and since the heads of the bolts are clamped to the wedge surfaces on both sides, the table has a high degree of stability. The downward adjustment is completely automatic, is accomplished by operating the adjusting lever, and results merely from the weight of the tabletop. To raise the tabletop, it must first be raised at the front, then the bolt heads must be moved inward by means of the operating rods. When the tabletop is released, the heads of the bolts then lie on the wedge surfaces at a higher level.

The adjustment can be made by one person alone without any special tools (except the lever) and is easily accomplished. Furthermore, the tabletop is secured in the side arms so it cannot fall down unintentionally, so accidents are prevented.

The continuous adjustment of the front part of the table described here can be combined with a known adjustment mechanism for the rear edge of the table, e.g., a pin and grid system. Preferably, however, infinite adjustment is also provided here, as described below.

For the rear adjustable mounting of the tabletop to the connecting beam 3, two bolts 27 are anchored at a distance from each other in the rear edge 26 of tabletop 1 with their free ends 28 inserted into two vertical guide slits 29 of connecting beam 3. The bolts 27 fit into two holes 30 of a follower rod 39 which is attached to two follower nuts 31 by means of screws 49. These follower nuts 31 rest on two vertical adjusting spindles 32 which are adjacent to the vertical slits 29 inside connecting beam 3.

Each adjusting spindle 32 is inserted at the bottom into a hole 33 of connecting beam 3 and supports at the top an axle 34 with a gear 35, so that the axle 34 and the toothed gear 35 are connected to spindle 32. The upper end of axle 34 is held in a disc 36 which is in turn riveted to the edge of the wall of connecting beam 3 which curves inward.

The two gear wheels 35 of adjusting spindles 32 are connected by means of toothed belt 37 so that when spindle 32 is turned, e.g., by means of a lever which is inserted into hexagonal hole 38 in the upper end of the axle, the other spindle is also turned.

Spindles 32 cause an upward or downward movement of the two follower nuts 31, depending on the direction in which they are turned, thus raising or lowering tabletop 1.

The holes 30 in the follower rod 39 should preferably be tapered to a point so that the tabletop can be raised somewhat, especially when it slopes at the front.

Figure 8:
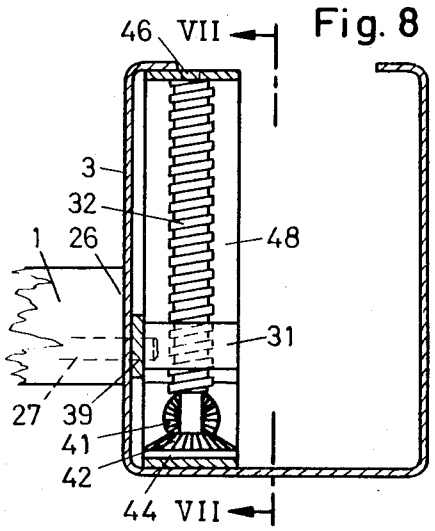
FIG. 8 shows a cross section through the connecting beam according to line VIII—VIII as per FIG. 7.
Figure 7:
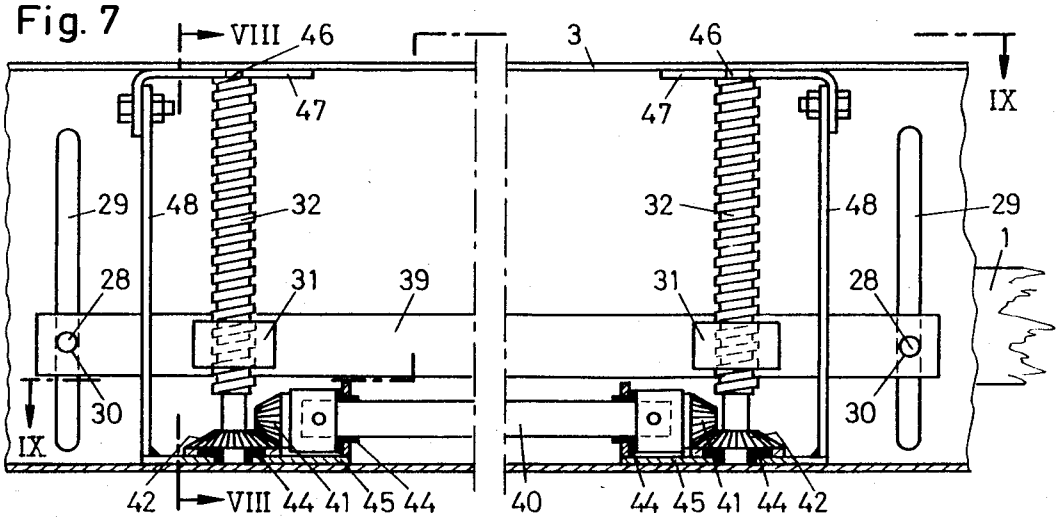
FIG. 7 shows a vertical longitudinal section through the connecting beam of another version according to line VII—VII as per FIG. 8.
Figure 9:
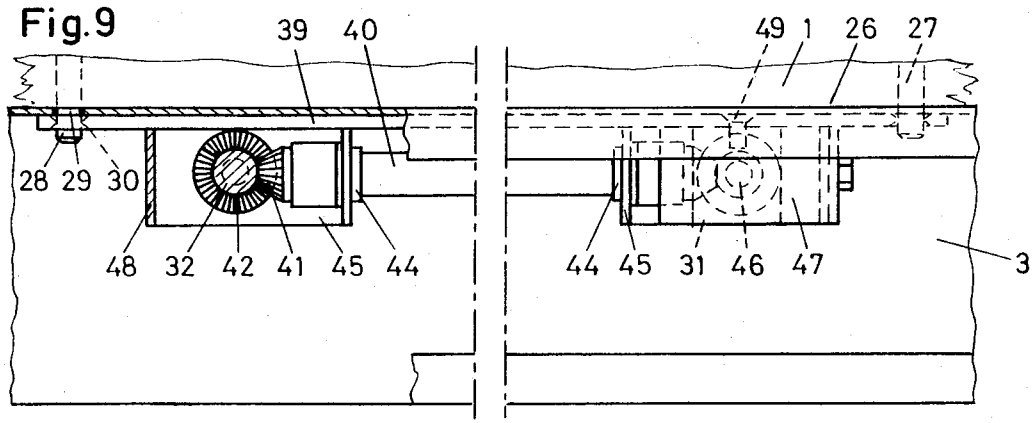
FIG. 9 shows a horizontal longitudinal section through the connecting beam according to line IX—IX as per FIG. 7.

As FIGS. 7 to 9 show, instead of the belt with the gear wheels, the connection between the two spindles 32 can also be accomplished by means of a shaft 40 which has a bevel wheel 41 on each end which meshes with the corresponding bevel wheels 42 at the lower ends of spindles 32.

Bevel wheels 41 and 42 are pinned to the ends of the spindles or the ends of the shafts, so the ends are held in bearing sleeves 44 which are in turn held in holders 45 which are bolted firmly to connecting beam 3.

The upper spindle bearing 46 is also reinforced by holder 47 so that the upper and lower holders 45 and 47 are connected to each other by a vertical support 48 to further increase the stability of the connecting beam 3 at this point.

The connecting rod 39 which consists of a flat steel bar is in turn attached to the follower nut 31 by means of screws 49. The vertical slits 29 for the tabletop bolts 27 are placed somewhat at the side of spindles 32 for reasons of space, as are the corresponding holes 30 in rod 39.

In contrast with the known spindle adjusting mechanism whereby the tabletop is attached only to the side arms of the furniture, the additional adjustable mounting in the connecting beam itself here yields a high stability for the furniture. In particular, the tabletop cannot sag in the middle.

The hollow side arms as well as the hollow connecting beams still have sufficient space to house lines and other organization facilities. Assembly and dismantling of the furniture are simple because the adjusting mechanism is preassembled. Adjustment is also easy and does not pose any problems and can also be performed without any special tools.

The tabletop is connected as a whole with the side arms and connecting beam 3 at four locations. It can be adjusted infinitely in height alone, in slope alone, or in both height and slope. The infinite rear adjustment could also be combined with a front pin and grid system of the known type.

Figures 10, 11:
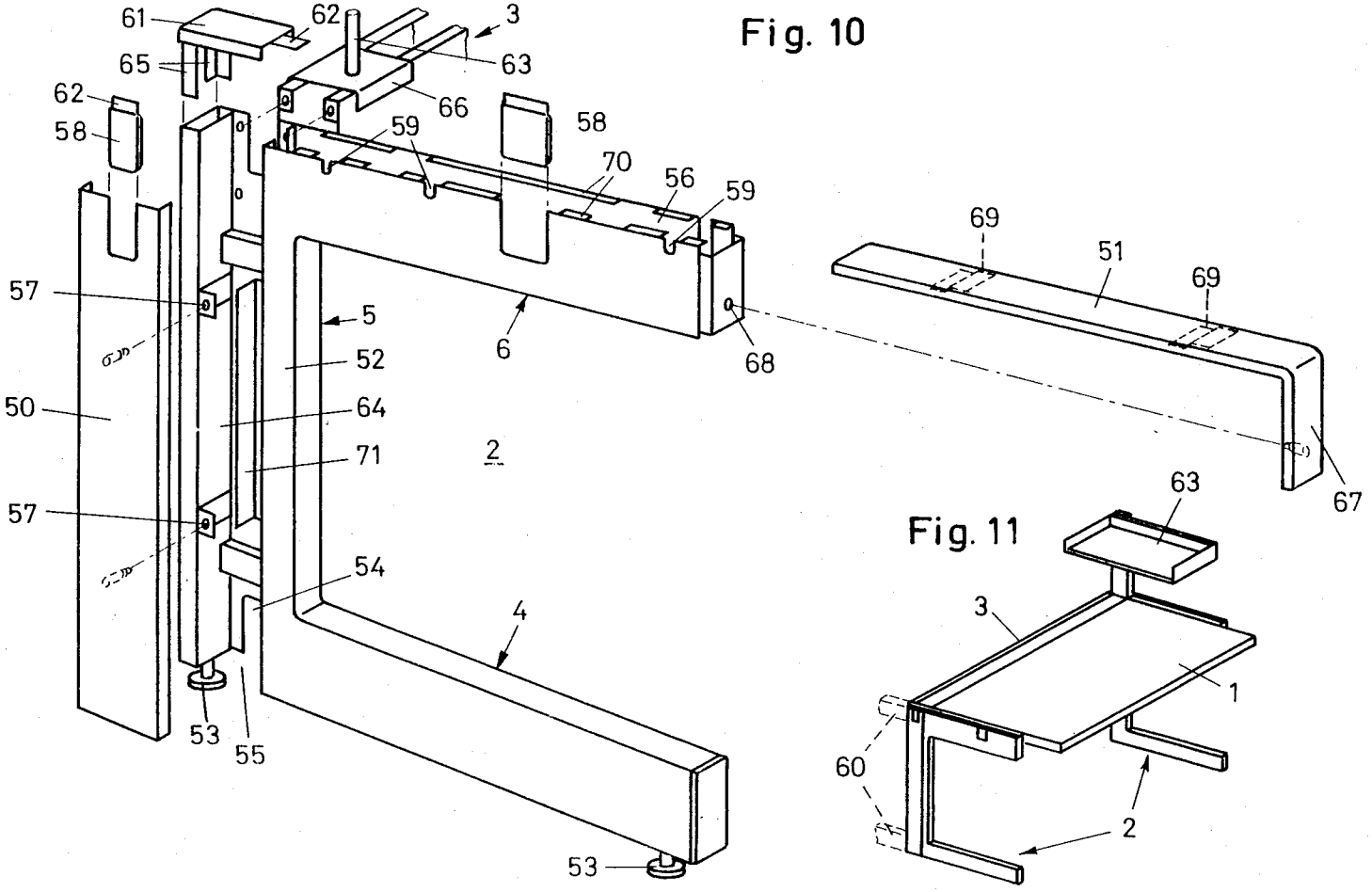
FIG. 10 shows a perspective view of the side part and connecting beam in exploded view.
FIG. 11 shows a perspective view of the desk, seen from above at the side.

The side part 2 shown in perspective view in FIG. 10 is made of sheet metal and consists of U-shaped main element as well as the straight side and top covers 50 and 51. If the foot is open at the side, the side cover 50 could also be L-shaped.

The U-shaped element is in the form of a partially open hollow profile so that the lower leg forms foot 4. Foot 4 is connected to a vertical supporting column 52 from which side arm 6 projects horizontally. Side arm 6 is the second leg of the U-shaped element. Known supporting screw 53 which are adjustable in height are located on foot 4.

Foot 4 has a recess 54 at the bottom for cables and lines in the extension of supporting column 52. Supporting column 52 has a vertical open channel 55 at the side. Finally, side arm 6 also has a slit-shaped recess 56 at the top through which the interior is accessible from above.

The recesses in the U-shaped element make it possible to insert electrical cables and signal lines into side part 2 in a simple way. Dividing wall 71 inside channel 55 of supporting column 52 is for the purpose of separating the high voltage electric lines from the low voltage signal lines.

After inserting the cable or lines, the side openings in foot 4 and in supporting column 52 can be covered by flat covering plates 50. The covering plate 50 at the side is connected to the base element by means of snap-on pins and snap holders 57 and is therefore easily pressed into position on the latter.

A slide 58 which is inserted at the top in side cover plate 50 can be removed if other modular units are to be attached at the side. By removing slide 58, access to the lines and cables inside the basic element is exposed, so that they can easily be inserted into a modular unit that is attached. Side arm 6 also has a removable slide 58 which serves the same purpose. There is also the possibility of attaching extension parts 60 at the rear of side arm 6 or foot 4, as indicated with dotted lines in FIG. 11.

The additional modular units can be attached to the base element by means of clamping screws (not shown) which are inserted into the open grooves 59 of side arm 6. Thanks to slide 58, electric cable connections and signal connections can be laid in the modular unit without being visible from the outside.

Supporting column 52 has a cover 61 which covers a projecting tongue 62 of slide 58 of side cover plate 50, securing it from accidental removal. Cover 61 in turn also has a tongue 62 which fits under the upper cover 51 so that cover 61 cannot be raised until after the upper cover 51 itself has been removed. Instead of cover 51, a plug-in unit, such as a lamp or a fixture 63 could be mounted on the supporting column.

For stability reasons, supporting column 52 has a reinforcing pipe 64 on the inside with a rectangular cross section. Cover 61 or a fixture 63 which is mounted on it instead has a plug 65 at the bottom which is inserted into the rectangular tube 64. Rectangular tube 64 runs the length of supporting column 52 and is self-supporting. The lining plate of supporting column 52 is welded to the pipe. Thanks to the supporting pipe, drawer and cabinet or enclosure elements can be attached easily.

Add-on fixtures 63 can also be attached to connecting beams 3, as FIG. 10 shows. This requires an adapter 66 which clamps around beam 3.

To close side arm 6, the upper cover 51 is pushed in from the front until its end 67 snaps into a snap holder 68 on the front of side arm 6. Cover 51 fits with tongues 69 into rails 70 which project inward, and it is supported by them. Slides 58, cover 61 or a corresponding plug-in unit as well as any clamping screws which may be present in grooves 59 are secured by upper cover 51.

The office furniture described here provides a measure of system flexibility which could not be achieved in the past. The attachment fixtures and linking elements can be attached with only a few manual operations and then removed again. The tabletops can be adjusted not only in height, but can also be inclined forward slightly or to a greater extent, which is regarded as very favorable from the standpoint of occupational medicine.

The tabletops can also be replaced rapidly without screws so the work place can be adapted to new requirements. Various plug-in units such as manuscript holders, telephones and briefcase attachments as well as desk lights can be attached to the supporting column or the connecting channel rapidly by means of adapters. Signal cables and electric lines can be inserted into the modular unit easily at any time and are not visible from the outside.

It is also possible, for example, to insert extensions into the front of the side arm. This is done by subdividing the inside of the side arm, where channel 5 serves as a guide for a section piece which is a component of the extension. In this version, cover 51 must also be longer or end 67 would have to be omitted.

Optionally, elements can also be suspended in the modular unit, attached to it or placed beneath the unit in the form of a container on casters.

This modular unit makes it possible in a simple and optimum manner to adapt single and multiple-person offices as well as functional rooms and offices.

The side adjusting mechanism which works together with the front part of the tabletop could be provided with a known form of threaded spindle mechanism instead of wedges.

We claim:

1. Furniture in modular design for setup at the work place, such that the modular unit has a framework which consists of two side parts each having a hollow side arm and a hollow connecting beam with a tabletop held adjustably in the framework, characterized by the fact that there is at least one bolt (27) at the rear edge of the tabletop (1) such that the projecting end of the bolt (27) fits into a vertical slit (29) of the hollow beam (3) which connects the two hollow side arms (6) of the modular furniture unit, and at least one vertical adjusting spindle (32), which has a follower nut (31), housed inside the beam (3) for vertical movement of the bolt (27) which connects with the nut (31) and thus permits vertical adjustment of the tabletop (1), and further characterized by the fact that two operating rods (10) which can be shifted equally in longitudinal direction are located in the front area of the tabletop (1) and each of their outer ends fits in one side arm (6) of the furniture, a wedge element (21) which tapers toward the top is located in each side arm (6) and has a bolt head (23) of the corresponding operating rod (10) resting on its wedge surface (22), the horizontal distance (25') between the wedge surfaces increases steadily toward the bottom, there is an adjusting mechanism (13,14,17,18) to achieve the movement of the operating rods (10) for the purpose of changing the distance (25') between the two bolt heads (23) so that each bolt head spacing (25') corresponds to a different height position of the front part of the tabletop (1).

2. Furniture according to claim 1, characterized by the fact that two spindles (32) are positioned at a distance from each other with one follower nut (31) on each spindle, a horizontal follower rod (39) attached to the two nuts (31), devices (35,37; 40,41,42) are provided for synchronous rotation of the two spindles (32), and there are at least two bolts (27) at the rear edge (26) of the table which are inserted into two slits (29) of the beam (3) which are separated from each other so the bolts fit into holes (30) in the follower rod (39).

3. Furniture according to claim 2, characterized by the fact that there is a toothed belt (37) which connects two gear wheels (35) which are positioned on the spindles (32) to achieve synchronous rotation of the spindles (32).

4. Furniture according to claim 2, characterized by the fact that the two spindles (32) are connected to each other by means of a gear which consists of bevel wheels (41,42) and a connecting shaft (40).

5. Furniture according to claim 1, characterized by the fact that the adjusting mechanism includes a hinged parallelogram (14,17,18) whose diagonally opposing corners are connected to the inside ends of operating rods (10) and the other corners act together with an adjusting spindle (13).

6. Furniture according to claim 1, characterized by the fact that the adjusting mechanism is loosely held in a lower recess (9) in the tabletop (1), and the operating rods (10) which are parallel to the front edge (16) of the tabletop each have at least one longitudinal slit (11) in which a guide screw (12) which is anchored in the tabletop (1) is inserted loosely.

7. Furniture according to claim 1, characterized by the fact that the side part (2) and the connecting beam (3) form an uninterrupted hollow space which can be closed by covers (50,51,61), and the side parts (2) each have a vertical column (5) with a self-supporting reinforcing pipe (64) running the entire length of the column.

8. Furniture according to claim 7, characterized by the fact that the upper end of the reinforcing pipe (64) which has a rectangular cross section is covered with a cover (61) with a plug (65) which projects into the pipe (64) or the plug of an attachment fixture is inserted into the pipe.

* * * * *